US006784865B2

(12) United States Patent
Akimoto et al.

(10) Patent No.: US 6,784,865 B2
(45) Date of Patent: Aug. 31, 2004

(54) PICTURE IMAGE DISPLAY DEVICE WITH IMPROVED SWITCH FEED THROUGH OFFSET CANCEL CIRCUIT AND METHOD OF DRIVING THE SAME

(75) Inventors: Hajime Akimoto, Oume (JP); Hideo Satou, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 277 days.

(21) Appl. No.: 09/881,719

(22) Filed: Jun. 18, 2001

(65) Prior Publication Data

US 2002/0033786 A1 Mar. 21, 2002

(30) Foreign Application Priority Data

Jul. 21, 2000 (JP) ..... 2000-226188

(51) Int. Cl.[7] ..... G09G 3/36
(52) U.S. Cl. ..... 345/98; 345/87; 345/99
(58) Field of Search ..... 345/87, 98

(56) References Cited

U.S. PATENT DOCUMENTS 5,414,443 A * 5/1995 Kanatani et al. ..... 345/95
5,648,791 A 7/1997 Date et al.
5,734,366 A * 3/1998 Kubota et al. ..... 345/100
6,064,362 A * 5/2000 Brownlow et al. ..... 345/98

OTHER PUBLICATIONS

"Low–Temperature Poly–Si TFT Data Drivers for an SVGA a–Si TFT LCD Panel" to Suzuki et al. Published Feb. 1999. pp. 21–24.*
"Low–Temperature Poly–Si TFT Data Drivers for an SVGA a–Si TFT LCD Panel", A. Suzuki et al, Display Manufacturing Technology Conference, Digest of Technical Papers, pp. 21–24.
"P–14 Low Output Offset, 8 bit Signal Drivers for XGA/SVGA TFT–LCDs", H. Minamizaki et al, Proceedings of the 16th International Display Research Conference, Eurodisplay 96, Oct. 1996, pp. 247–250.

* cited by examiner

*Primary Examiner*—Dennis-Doon Chow
*Assistant Examiner*—Ming-Hun Liu
(74) *Attorney, Agent, or Firm*—Antonelli, Terry, Stout & Kraus, LLP

(57) ABSTRACT

By changing circuit connections at predetermined 4 timings, a switch feed through offset cancel circuit which permits canceling fluctuation in output offset of an analog picture image signal voltage due to fluctuation of semiconductor elements characteristics in the circuit. Thereby, a uneven brightness in a form of vertical stripe shape, which deteriorates picture quality, due to fluctuation in switch feed through charges of an offset cancel circuit is eliminated in a TFT LC display device having a buffer amplifier.

24 Claims, 8 Drawing Sheets

MEMORY 1 OF OFFSET AMOUNT

SUBTRACTION 1 OF OFFSET

MEMORY 2 OF OFFSET AMOUNT

SUBTRACTION 2 OF OFFSET

PICTURE IMAGE DISPLAY DEVICE WITH IMPROVED SWITCH FEED THROUGH OFFSET CANCEL CIRCUIT AND METHOD OF DRIVING THE SAME

BACKGROUND OF THE INVENTION

1. Field of the Invention

The present invention relates to a liquid crystal (hereinbelow, will be referred to as LC) picture image display device which, in particular, permits a picture image display of a high quality.

2. Conventional Art

Hereinbelow, a conventional art will be explained with reference to FIG. 11.

FIG. 11 is a structural diagram of an offset cancel buffer circuit in a low temperate poly-Si drive circuit used for a conventional TFT LC panel drive. An analog input signal Vin is buffered by a negative fed back differential amplifier circuit 155 and is output as an analog output Vout to a TFT LC panel. Two negative feed back routes, one via switch 153 and the other via a switch 152 are provided, and the route via the switch 152 is routed through a capacitor 151. Further, from a junction between the switch 152 and the capacitor 151 a wiring is connected to the input portion Vin via a switch 154.

Now, an operation of the conventional circuit will be explained. Positive and Negative input portions of the differential amplifier circuit 155 are constituted by a low temperature poly-Si TFT, however, since the element characteristics of a low temperature poly-Si TFT generally fluctuate largely in comparison with a single crystal MOS transistor, therefore, if a simple feed back is effected, a large fluctuation in output offset voltage is caused for every buffer circuit in a voltage follower circuit, an uneven brightness in a form of vertical stripes is induced on an LC panel display. Therefore, in the present conventional circuit, in order to cancel the offset voltage, an offset cancel circuit is introduced. During the former half of the horizontal scanning period the switches 153 and 154 are turned on and the switch 152 is turned off. In this instance, an output offset voltage of the differential amplifier circuit 155 with a negative feed back loop is stored in the capacitor 151. Subsequently, during the later half of the horizontal scanning period, the switches 153 and 154 are turned off and the switch 152 is turned on. In a new negative feed back loop produced by this operation the capacitor 151 which stores the output offset voltage is added in series, the output offset voltage is subtracted by the differential amplifier circuit 155. Namely, with thus structured circuit, the output offset voltage can be canceled.

With regard to the above referred to conventional art, for example, Ryuichi Hashido et al. "An Offset Cancel Circuit for Integrated Data-Driver Composed of Low-Temperature Poly-Si TFTs" (TECHNICAL REPORT OF IEICE (THE INSTITUTE OF ELECTRONICS, INFORMATION AND COMMUNICATION ENGINEERS) EID 98-125 (1999–01) pp91~96) explains in details.

Further, with regard to a structure of surrounding circuits when a TFT LC panel is driven while constituting an offset cancel buffer circuit with an LSI, for example, H. Minamizaki et al. "Low Output Offset, 8 bit Signal Drivers for XGA/SVGA TFT-LCDs" (Proceedings of Euro Display '96, pp274~250) explains in details.

According to the above conventional art, it is possible to cancel the offset voltage due to mismatching in the differential amplifier circuit. However, the inventors found out that the switch 153 (FET (Field Effect Transistor) switch) becomes a new major ground of fluctuation in output offset voltage, and in order to further enhance an output voltage accuracy of the offset cancel circuit the above new major ground has to be resolved which will be explained likely by making use of FIG. 11.

For the sake of the following explanation, it is assumed that the capacity of the capacitance 151 is as Cm and switch feed through charges caused when the switch 153 is turned off are as q1 and q2 as illustrated in the drawing, and further an open gain of the differential amplifier circuit 155 is as G.

At first, the switches 153 and 154 are turned on and after causing to store the output offset voltage of the differential amplifier circuit 151 into the capacitor 151 having capacitance of Cm, the switches 153 and 154 are turned off. It is well known that at this moment the TFTs constituting the respective switches discharge to their sides of source and drain feed through charges. As the result thereof, q1 among the feed through charges of the switch 153 is added to the charge originally stored in the capacitor 151 having the capacitance Cm to modulate the voltage between the capacitor 151. A new offset voltage ΔVout which is caused at the output Vout of the offset cancel buffer circuit due to q1 after the above offset cancel operation is determined by the following equation.

$$\Delta V\text{out}=-q1\cdot G/(G+1)\cdot Cm \quad (1)$$

Since the open gain G of the differential amplifier circuit 155 is generally designed in an extremely large value, therefore, if a sufficiently large value is assumed for G in equation (1), it is understand that generation of the offset voltage ΔVout determined by (−q1/Cm) due to the feed through charge by the switch 153 can not be avoided. Further, in this instance, the charge q2 caused by the switch 153 affects no important effect.

Since the role of the buffer circuit is an impedance conversion, it is not desirable to design the input impedance small, therefore, the capacity Cm of the capacitor 151 can not be determined too large. Therefore, the new offset voltage ΔVout causes a large problem when enhancing the output voltage accuracy of the buffer circuit. If (−q1/Cm) is a constant value, an external correct is possible. However, the problem to be resolved here is the uneven brightness in a form of vertical stripe shape induced in a displayed picture image on the TFT LC panel due to the fluctuation of q1, an external correction thereof is difficult. Hereinbelow, the offset fluctuation due to the above fluctuation in q1 is referred to as "switch feed through offset fluctuation".

Further, if a single crystalline MOS transistor is used for the switch 153, the threshold voltage Vth thereof generally fluctuates about 20 mV at maximum as well as the gate size thereof is in a degree of submicron. Therefor, the above "switch feed through offset fluctuation" can be suppressed with a capacitor having a comparatively small Cm. However, if, for example, a poly crystalline Si-TFT is used for the switch 153, since a crystal grain structure is included in a channel portion and a defect level density of a gate insulation film boundary is non-uniform, the threshold voltage Vth fluctuates from several 100 mV to about 1V at the maximum. Further, the size of a processed substrate is comparatively large from several 10 cm to 1 m, a minimum processable gate size is a few micron, therefore, the fluctuation in the processed size is comparatively large. The switch feed through charge q1 is primarily proportional to a channel charge Cg·(Vg−Vth). Wherein Cg is a gate capacitance determined by the gate area, the gate insulation film thickness and the gate insulation film dielectric constant. Accordingly, the fluctuation in the threshold voltage Vth and the gate area as they are directly reflects to the switch feed through charge q1. For example, when it is assumed that the fluctuation in the threshold voltage Vth is 1V, the capacitance ratio between the switch 153 and the capacitor 151 having a capacitance Cm is 100 times and the half of the channel charge of the switch 153 is equivalent to q1, fluctuation of 5 mV at the output is caused when the open gain G of the differential amplifier circuit 155 is approximated to infinite. Actually, fluctuation due to such as fluctuation in processed size of the gate area is added, therefore, along the conventional approach it is difficult to reduce the fluctuation in the output offset voltage of the buffer circuit to a practical level.

In the above, a problem included in the offset cancel circuit due to the switch 153 as shown in FIG. 11 has been explained. However, it should be pointed out that such problem is not an inherent problem with respect to FIG. 11 circuit, but a common problem with regard to a usual offset cancel circuit. An offset cancel circuit operates to apply an offset voltage stored in advance in a capacitor to an input of a differential amplifier circuit to perform subtraction, and for this reason, one end of the capacitor has to be connected to an input of the differential amplifier circuit. Further, in order to write the offset voltage in the capacitor, the one end of the capacitor has also to be connected to the switch. Therefore, the feed through charges caused when the switch is turned off are inherently added to the capacitor, as a result, the feed through charges are applied as an error voltage to the input of the differential amplifier circuit.

According to the above consideration, with the offset cancel buffer circuit using FETs the fluctuation in feed through charge q1 of the offset cancel use switch connected to the input of the differential amplifier circuit induces the new offset voltage fluctuation as referred to as "switch feed through offset fluctuation" and in order to further enhance the output voltage accuracy of the buffer circuit a new counter measure therefor is necessary.

Further, even if the switch 153 which caused the above explained problem of the feed through charges is constituted by such as n type TFT, p type TFT and CMOS TFT, it will be apparent that the same problem is caused in view of the "fluctuation" in the feed through charges.

SUMMARY OF THE INVENTION

The above problems can be resolved by a picture image display device according to the present invention which comprises a liquid crystal opposing electrode to which a predetermined voltage is applied; a pixel electrode which is provided so as to form a liquid crystal capacitor with the liquid crystal opposing electrode; a pixel switch connected in series with the pixel electrode; a plurality of display pixels arranged in a matrix shape for performing picture image display; a picture image signal voltage generation means which outputs a first analog picture image signal voltage based on picture image data to be displayed; a group of output impedance conversion means using a semiconductor element to which the first analog picture image signal voltage is inputted and which outputs a second analog picture image signal voltage with a lower output impedance than that of the picture image signal voltage generation means; an offset cancel capacitor which is provided in the output impedance conversion means for canceling an output offset fluctuation of the second analog picture image signal voltages due to fluctuation of the semiconductor characteristic in the group of the respective output impedance conversion means and of which one terminal is connected to a voltage input terminal of the output impedance conversion means; an offset cancel circuit group which includes a first semiconductor switch of which one terminal is connected likely to the voltage input terminal of the output impedance conversion means; a signal line group which connects output terminals of the output impedance conversion means in group with the pixel switches in group; and a signal voltage writing means which writes the second analog picture image signal voltage representing the outputs of the output impedance conversion means in group via the signal lines in group and the pixel switches in group into a liquid crystal capacitor in a predetermined display pixel; and is further newly provided with means for reducing an output fluctuation in the second analog picture image signal voltage due to fluctuation in feed through charges caused when the first semiconductor switch is turned off.

DETAILED DESCRIPTION OF THE EMBODIMENTS

First Embodiment

Hereinbelow, a first embodiment of the present invention will be explained with reference to FIGS. 1 through 5 and Table 1.

Figure 3:
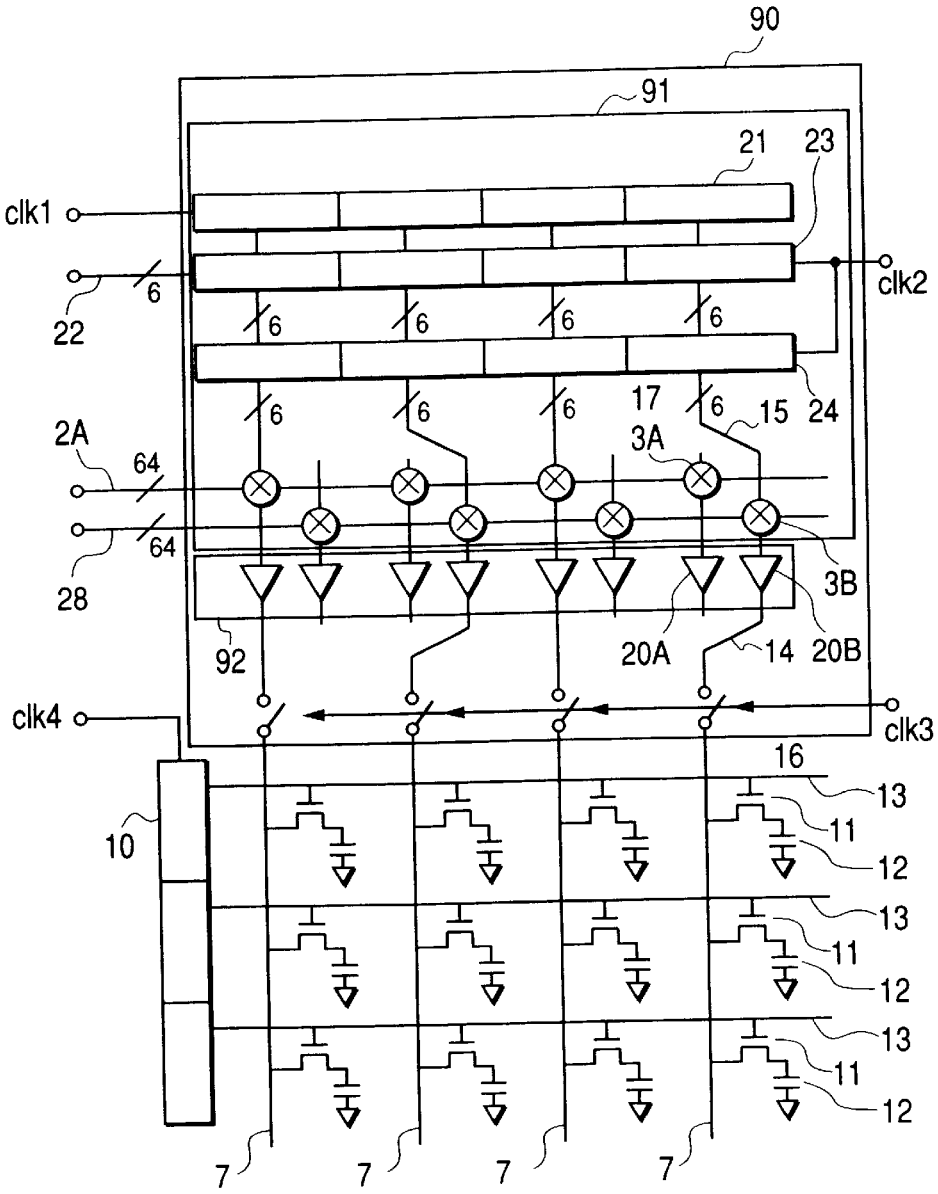
FIG. 3 is a structural diagram of a poly crystalline Si-TFT LC display panel in the first embodiment of the present invention.

FIG. 3 is a structural diagram a poly crystalline Si-TFT LC display panel representing the present embodiment.

Display pixels, each of which is constituted by a LC capacitor 12 formed between a pixel electrode and a LC opposing electrode applied of a predetermined voltage and a pixel TFT 11 connected to the LC capacitor 12, are arranged in a matrix shape and constitute a picture image display region. The gate of the pixel TFT 11 is connected to a gate line drive circuit 10 via a gate line 13. Further, the drain of the pixel TFT 11 is connected to a signal line drive circuit 90 via a signal line 7. More specifically, the drain electrode of the pixel TFT 11 is connected via the signal line 7 to an analog buffer output switch 16 in the signal line drive circuit 90. The other end of the analog buffer output switch 16 is connected via a gradation change-over switch 14 to an output terminal of either of analog buffers 20A and 20B and the input terminals of the analog buffers 20A and 20B are respectively connected to gradation selecting switches 3A and 3B. Herein either of the analog buffers 20A and 20B and either of the gradation selecting switches 3A and 3B are selected by the gradation change-over switches 14 and 15. Herein, the gradation selecting switches 3A and 3B are constituted as a multiplexer and function as a decoder of a D/A converter through connecting a predetermined one of gradation power source lines 2A and 2B selected by a gradation selecting line 17 to the output thereof. Further, in FIG. 3 a portion constituted by a latch address selection circuit 21, a primary latch circuit 23, a secondary latch circuit 24 and the gradation selecting switches 3A and 3B is a picture image signal voltage generation unit 91 and a portion constituted by the analog buffers 20A and 20B forms an output impedance conversion means 92 in group.

Further, in the present embodiment since the picture image display data are determined in 6 bits, the gradation power source lines 2A and 2B are respectively constituted by 64 pieces of parallel wiring lines to which respectively different gradation voltages are applied. On the other hand, the gradation selecting line 17 is outputted from the primary latch circuit 23 via the secondary latch circuit 24, and to the primary latch circuit 23 a digital input line 22 and the latch address selection circuit 22 are inputted. The above respective circuit blocks are constituted on a glass substrate by making use of poly-crystalline Si-TFT elements, and herein the respective switches use CMOS switches constituted by making use of poly crystalline Si-TFTs. Further, in the present embodiment, in order to simplify explanation a conventional structure necessary for forming a TFT panel such structures as for a color filter and for a back light are omitted.

Hereinbelow, an operation outline of the LC display panel according to the present embodiment will be explained. Further, the details of the structure and the operation timing of the analog buffers 20A and 20B will be explained later with reference to FIGS. 1, 2, 4, and 5 and Table 1. The picture image display data inputted in the digital data input line 22 are latched in the primary latch circuit 23 having address selected by the latch address selection circuit 21. When a latching of picture image display data necessary for writing one line is completed within one horizontal scanning period, these picture image display data are collectively transferred from the primary latch circuit 23 to the secondary latch circuit 24 and during the subsequent horizontal scanning period the secondary latch circuit 24 outputs these picture image data to the gradation selecting line 17. The gradation selecting switches 3A and 3B constituted by decode switches in group supply, depending on the content of the gradation selecting line 17, a predetermined analog picture image voltage from the gradation power source lines 2A and 2B to the analog buffers 20A and 20B. The analog buffers 20A and 20B supply the picture image signal voltage corresponding to the supplied picture image signal voltage via the analog buffer output switch 16 to the signal line 7. Roles of the analog buffers 20A and 20B are to reduce the output impedance at this moment lower than the output impedance in the gradation selecting switches 3A and 3B so as to enhance writing speed of the signal voltage into the signal line 7 as well as to prevent a possible cross talk such as by capacitive coupling of the signal lines 7 each other possibly caused by outputting the picture image signal voltage with a low impedance. In the present embodiment, the analog buffers 20A and 20B are provided with, in addition to the offset cancel function for compensating the offset voltage fluctuation by the analog buffers themselves which will be explained later, a function of canceling "switch feed through offset fluctuation" due to the feed through charges caused by the offset cancel circuit. The picture image signal voltage with no offset fluctuation inputted into the signal line 7 is written into a predetermined LC capacitor 12, when the gate line drive circuit 10 turns on pixel TFTs 11 in a predetermined line via a gate line 13.

Now, the circuit structure of the analog buffers 20A and 20B will be explained with reference to FIGS. 1 and 2 and Table 1. In the present embodiment, since the analog buffers 20A and 20B have the same basic structure, therefore, they are simply referred to as an analog buffer 20 hereinbelow.

TABLE 1

| | $\phi 1$ | $\phi 2$ |
|---|---|---|
| A | + | − |
| B | − | + |

Figure 1:
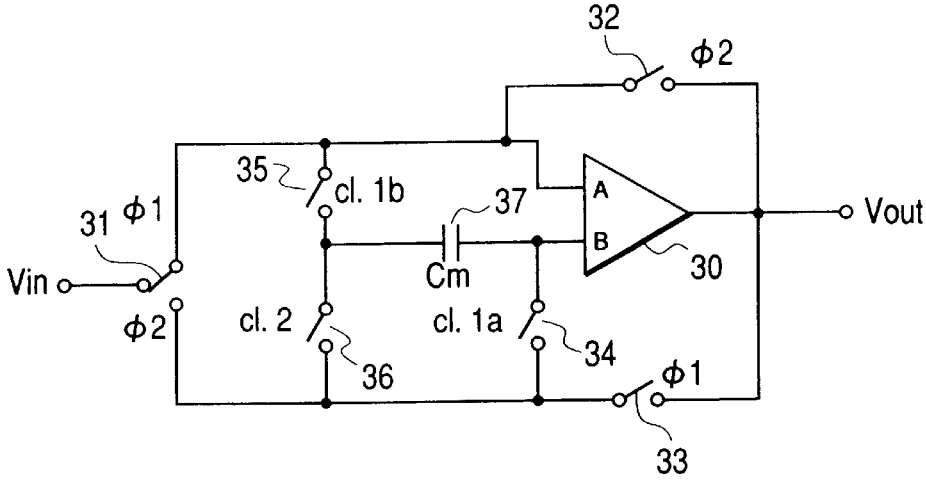
FIG. 1 is a structural diagram of an analog buffer circuit in a first embodiment of the present invention.

FIG. 1 is a structure diagram of an analog buffer 20 which includes the above explained offset cancel function and switch feed through offset cancel function.

Input terminals of the analog buffer 20 are coupled to a change-over switch 31 which changes over depending on phases $\phi 1$ and $\phi 2$. One stationary terminal of the change-over switch 31 is connected to a switch 35 which is turned on by a clock cl.1*b*, a switch 32 which is turned on by the phase $\phi 2$ and one of two input terminals of a differential amplifier 30, and the other stationary terminal of the change-over switch is connected to a switch 36 which is turned on by a clock cl.2, a change-over switch 34 which is turned on by a clock cl.1*a* and a switch 33 which is turned on by the phase $\phi 1$. Further, the other input terminal of the differential amplifier 30 is connected to the change-over switch 34 which is turned on by a clock cl.1*a* and a cancel capacitor 37 of which other terminal is connected to the switch 35 which is turned on by a clock cl.1*b* and the switch 36 which is turned on by a clock cl.2. Further, the output terminal of the differential amplifier 30 is connected to the output terminal of the analog buffer 20 as well as connected to the switch 32 which is turned on by the phase $\phi 2$ and the switch 33 which is turned on by the phase $\phi 1$. Further, the input terminals A and B of the differential amplifier 30 as illustrated in the drawing are changed over to (+, −) when the phase is $\phi 1$ and to (−, +) when the phase is $\phi 2$ as shown in Table 1.

Figure 2:
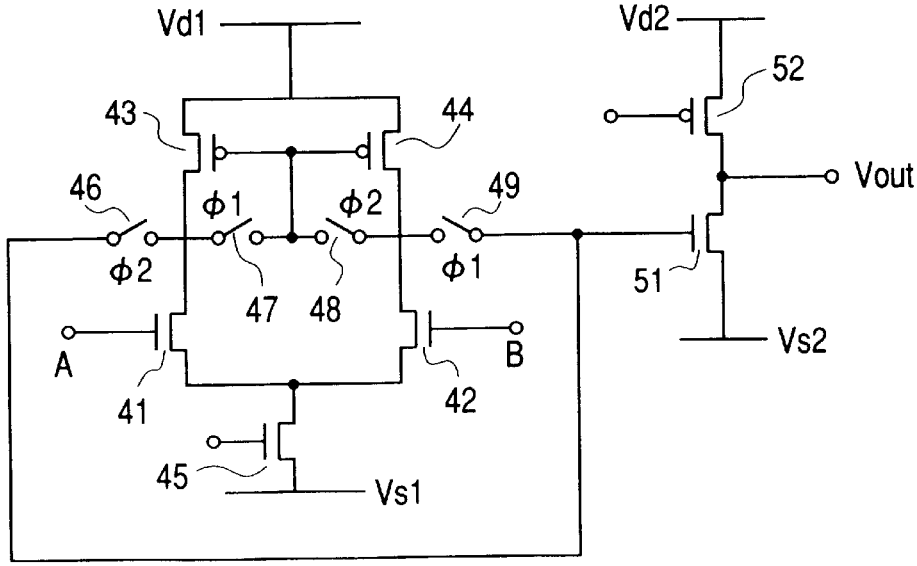
FIG. 2 is a structural diagram of a differential amplifier circuit in the first embodiment of the present invention.

FIG. 2 is a diagram of the differential amplifier 30 having the above explained functions.

The differential amplifier 30 is constituted by an initial stage differential circuit and a subsequent stage source follower circuit. The initial stage differential circuit is constituted by poly crystalline Si-driver TFTs 41 and 42, poly crystalline Si-load TFTs 43 and 44 and a poly crystalline Si-current source TFT 45, and of which differential output terminal can be changed over by poly crystalline Si-switch TFTs 46, 47, 48 and 49 in group which are changed over by the phases $\phi 1$ and $\phi 2$. With these switches in group the positive and negative polarities for the input terminals A and B of the differential amplifier 30 are changed over. The subsequent stage source follower circuit, which is constituted by a poly crystalline Si-driver TFT 51 and a poly crystalline Si-load TFT 52 which is driven with a predetermined bias, is provided for achieving a matching of a large output current supply with an operating point voltage. In the drawing the symbols Vd1, Vs1, Vd2 and Vs2 are respectively voltages of high and low voltage sources for the initial stage differential circuit and for the subsequent stage source follower circuit.

Figure 4A:
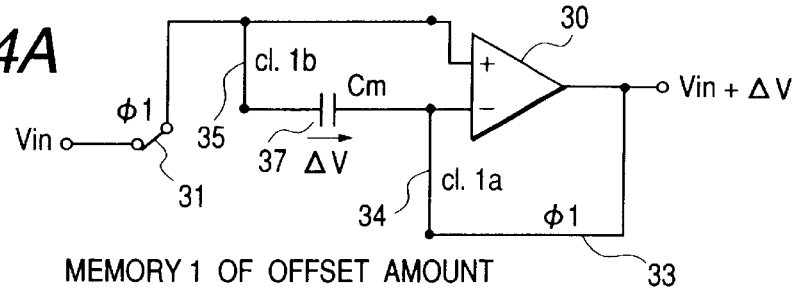
FIGS. 4A through 4D are diagrams for explaining operation of the analog buffer circuit in the first embodiment of the present invention.

Hereinbelow, an operation of the present embodiment will be explained in detail with reference to FIGS. 4A through 5.

Figure 4B:
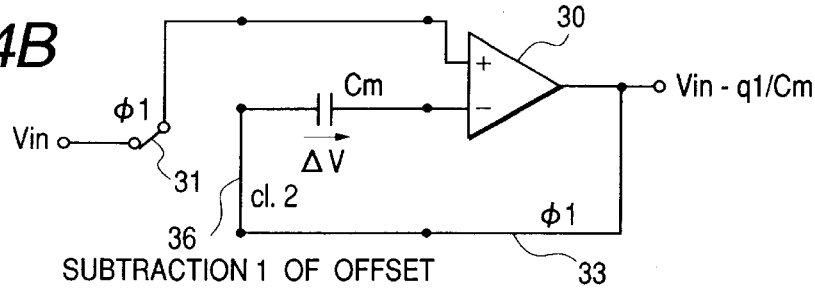

At first, the operation of the analog buffer 20 will be explained with reference to FIGS. 4A through 4D. During the former half of the phase ϕ1 the analog buffer 20 performs memory 1 of offset amount by closing the switches 34 and 35 as shown in FIG. 4A. At this moment, an offset voltage of the analog buffer 20 is inputted between the cancel capacitor 37 having capacitance Cm. Subsequently, during the later half of the phase ϕ1 the switch 36 is closed and subtraction 1 of offset amount is performed as shown in FIG. 4B. At this moment, since the cancel capacitor 37 which stores the offset voltage ΔV of the analog buffer 20 is inserted into a negative feed back loop of the analog buffer 20, the output voltage of the differential amplifier 30 is reduced by ΔV. Thereby, the offset voltage ΔV of the analog buffer 20 is canceled, however, as has been explained in CONVENTIONAL ART above, a switch feed through offset voltage due to the feed through charge q1 caused at the negative input terminal side of the differential amplifier 30 when the switch 34 is turned off appears at the output terminal of the analog buffer 20 by the amount of (−q1/Cm).

Figure 4C:
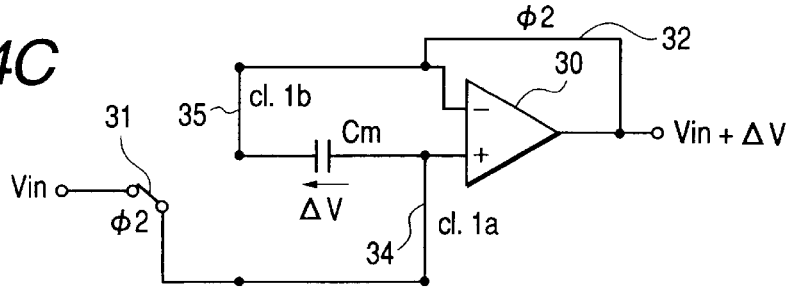
Figure 4D:
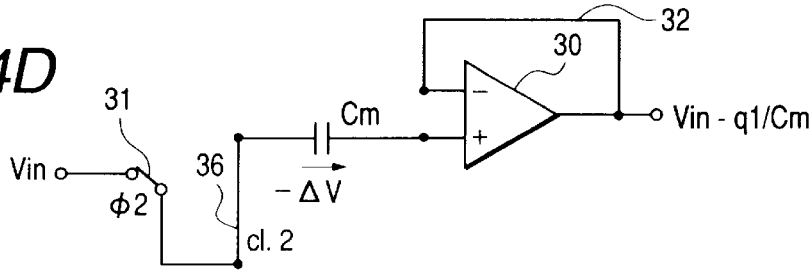

Subsequently, during the former half ϕ2 the analog buffer 20 performs memory 2 of offset amount after closing the switches 34 and 35 as shown in FIG. 4C. At this moment, also the offset voltage ΔV of the analog buffer 20 is inputted between the cancel capacitor 37. Subsequently, during the later half of the phase ϕ2 the subtraction 2 of offset amount is performed after closing the switch 36 as shown in FIG. 4D. At this moment, the cancel capacitor 37 which stores the offset voltage ΔV of the analog buffer 20 is inserted to the positive input terminal of the analog buffer 20, therefore, the output voltage of the differential amplifier 30 is reduced by ΔV. Thereby, the offset voltage ΔV of the analog buffer 20 is canceled, however, like the above, the switch feed through offset voltage due to the feed through charge q1 caused at the positive input terminal side of the differential amplifier 30 when the switch 34 is turned off appears at the output terminal of the analog buffer 20 by the amount of (+q1/Cm). However, when assuming that the voltages inputted to the analog buffer 20 at the time of phases ϕ1 and ϕ2 are the same, since the switch feed through offset voltages generated herein are caused under the same voltage condition from the basically identical TFT, and the values q1 of the both are equal, therefore, it is understood that the switch feed through offset voltage caused at the output terminal of the analog buffer 20 at the time of the phases ϕ1 and ϕ2 are inverted polarities having the same absolute value. Accordingly, when changing over the phases ϕ1 and ϕ2 alternatively for every frame, the switch feed through offset voltage can be visually canceled, thereby, the problematic fluctuation in the switch feed through offset voltage can be eliminated at the same time.

Figure 5:
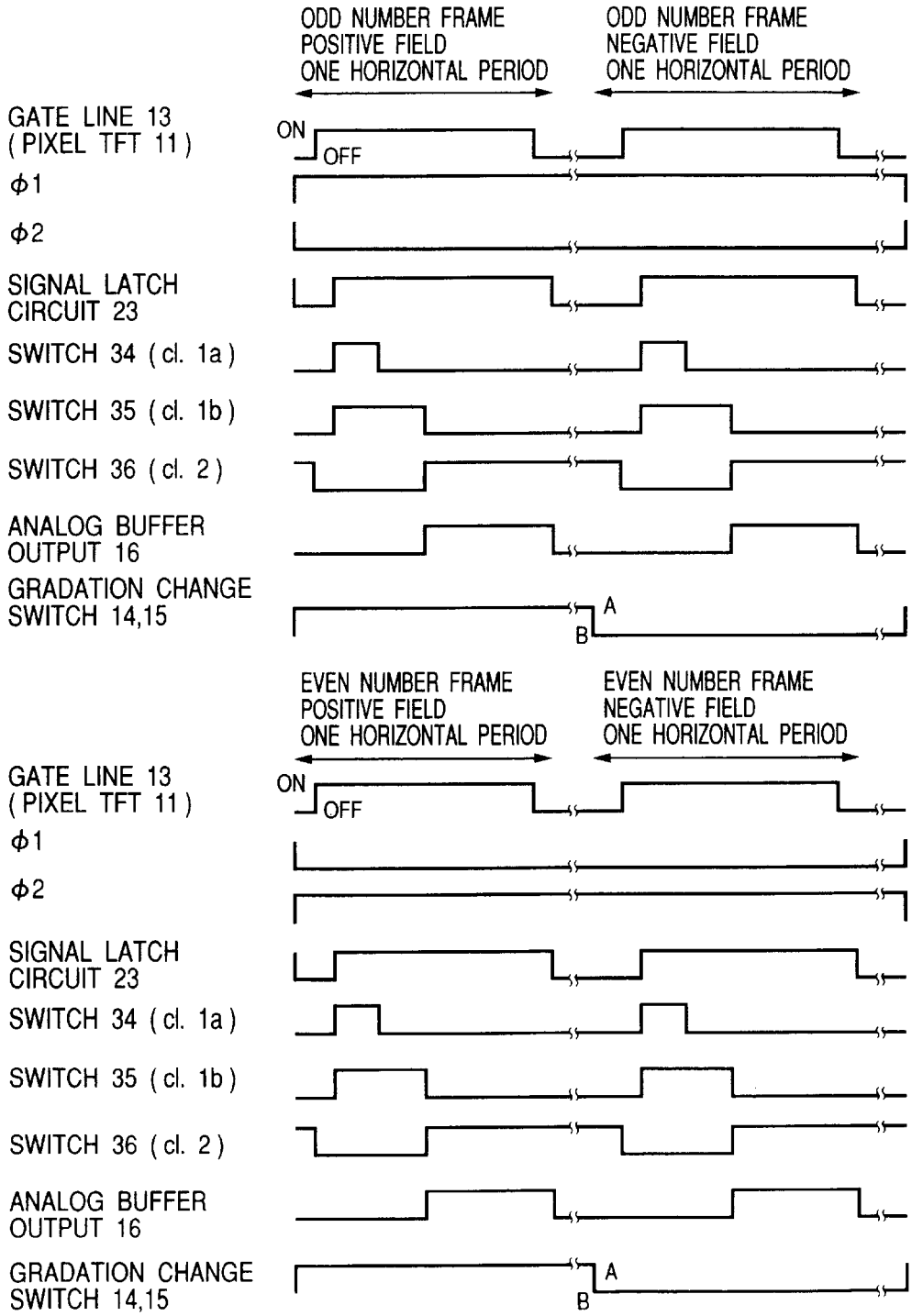
FIG. 5 is a timing chart of the first embodiment of the present invention.

FIG. 5 is a time chart according to the present embodiment with respect to respective operation pulses in a certain row at the time of writing into a same pixel line during a period of two frames (=four fields). The present embodiment is driven with a repeating unit of odd and even two frames. In the present time chart, the on/off of a switch is illustrated by a high and low levels as indicated in the drawing. However, with regard to the gradation change over switches 14 and 15, the high level indicates A and the low level indicates B so as to correspond to the selected analog buffers 20A and 20B and gradation selecting switches 3A and 3B.

At the start of the odd frame and positive field period the phase ϕ1 is selected and the gradation change-over switches 14 and 15 are changed over toward selection A. Subsequently, a predetermined gate line 13 (pixel TFT 11) which is selected by the gate line drive circuit 10 is turned on, and the switch 36 in the analog buffer 20A is turned off. Then, the operation of the offset cancel circuit in the analog buffer 20A is started. Namely, the output of the primary latch circuit 23 is turned on as well as the switches 34 and 35 are turned on and the offset voltage of the differential amplifier 30 is inputted between the cancel capacitor 37. Subsequently, the switch 34 and the switch 35 are turned off in this order, of which turn-off order is important in order to remove the influence of the feed through charge caused by the switch 35. If the switch 34 is turned off earlier, the feed through charge of the switch 35 caused later is not inputted into the cancel capacitor 37, thus the influence caused thereby can be avoided. Subsequently, through the turning on of the switch 36 the offset voltage of the differential amplifier 30 stored in the cancel capacitor 37 is inputted into the negative feed back loop, thereby, the offset voltage due to TFT non matching of the differential amplifier 30 using poly crystalline Si-TFTs is canceled. Under this condition, when the analog buffer output switch 16 is turned on, a picture image signal voltage is outputted to a signal line 7 from the analog buffer 20A. Under this condition as has been referred to above, the fluctuation in feed through charge of the switch 34 connected to the input of the differential amplifier 30 is inputted to a pixel via a signal line 7 as a switch feed through offset voltage in an amount of (−q1A/Cm), wherein a switch feed through charge of the switch 34 in the analog buffer 20A is indicated as q1A. Thereafter, since the gate line (pixel TFT 11) and the analog buffer output switch 16 are turned off, the writing operation for the pixels corresponding to the selected one line is completed. A role of the analog buffer output switch 16 is to isolate the output of the analog buffers 20A and 20B from the signal line 7 depending on necessity and to accelerate a built-up of the output of the analog buffers 20A and 20B at the time of the offset voltage cancel operation.

Now, an operation at the time of writing the same pixel line during an odd frame and negative field period as illustrated will be explained. The writing operation concerned is basically the same as that during the above explained odd frame and positive field period except that the gradation change-over switches 14 and 15 are changed over toward selection B. In the present embodiment, through the changing over the gradation change-over switches 14 and 15 depending on positive/negative field an AC drive for a LC is realized. Even during the present period, the fluctuation in feed through charge of the switch 34 connected to the input of the differential amplifier 30 is inputted to a pixel via a signal line 7 as a switch feed through offset voltage in an amount of (−q1B/Cm), wherein the switch feed through charge of the switch 34 in the analog buffer 20B is indicated as q1B. At this moment, since the analog buffer 20B is used instead of the analog buffer 20A, it will be apparent that the value q1B is totally independent from the value q1A.

Now, an operation at the time of writing the same pixel line during the even frame and positive field period as illustrated will be explained. The writing operation concerned is substantially the same as that during the odd frame and positive field period except that the phase ϕ2 is selected.

In this instance as has been explained above, the fluctuation in feed through charge of the switch 34 connected to the input of the differential amplifier 30 is inputted to a pixel via a signal line 7 as a switch feed through offset voltage in an amount of (+q1/Cm). If the picture image data to be displayed do not substantially vary between the odd frame and positive field period and the even frame and positive field period, the both switch feed through offset voltages are visually canceled and generation of the uneven brightness in a form of stripe shape is avoided. A condition where the uneven brightness visually causes a problem is when in particular the values of display picture image data do not vary largely for a long time, therefore, the above offset voltage cancel operation is in practice sufficiently effective.

Lastly, an operation at the time of writing the same pixel line during the even frame and negative field period as illustrated will be explained. The writing operation concerned is substantially the same as that during the odd frame and negative field period except that the phase ϕ2 is selected, and the visual cancel effect of the switch feed through offset voltage with the present operation is the same as the above, therefore, the detailed explanation thereof is omitted.

In the present embodiment, the respective circuit blocks are constituted on a glass substrate by making use poly crystalline Si-TFT elements. However, in place of the glass substrate, a quartz substrate, a transparent plastic substrate can be used, and further, by modifying the LC display scheme to a reflection type it is possible to use an opaque substrate including a Si substrate.

Further, it is of course possible to reverse the conductivity type of the TFTs in the differential amplifier circuit from n type to p type and to modify the circuit structure thereof in a range without altering the principle of the present invention. In order to enhance a gain of the differential amplifier 30 it is also effective to use a cascode structure. Since a TFT has an advantage having no substrate bias effect, however, has a disadvantage having a large drain conductance, therefore, although a bias terminal is newly necessitated, in order to ensure a gain of over several 100 times for a differential amplifier circuit, it is effective to use such cascode structure.

In the present embodiment, in order to simplify the explanation, the picture image display data are assumed to be 6 bits and the gradation power source lines are assumed to be 64 pieces of parallel wiring lines to which respectively different gradation voltages are applied, however, it will be apparent if the picture image display data is n bits, the number of the gradation power source lines are $2^n$ pieces of parallel wiring lines to which respectively different gradation voltages are applied.

Still further, in the present embodiment, the switch groups are constituted by CMOS switches and the pixel TFTs use n type TFT switches, however, any switch structures including p type TFT can be used for the switches in the present embodiment. Further, a variety of structures and layout such as a reflection type display pixel structure can be applied without departing the spirit of the present invention.

Second Embodiment

Since the overall structure of the poly crystalline Si-TFT LC display panel of the second embodiment is the same as that of the first embodiment, the explanation thereof is omitted. A difference of the present embodiment from the first embodiment is in the operation timing of the respective operation pulses. Hereinbelow, the point will be explained.

The operation of the second embodiment of the present invention will be explained with reference to FIGS. 6 and 7 hereinbelow.

Figure 6:
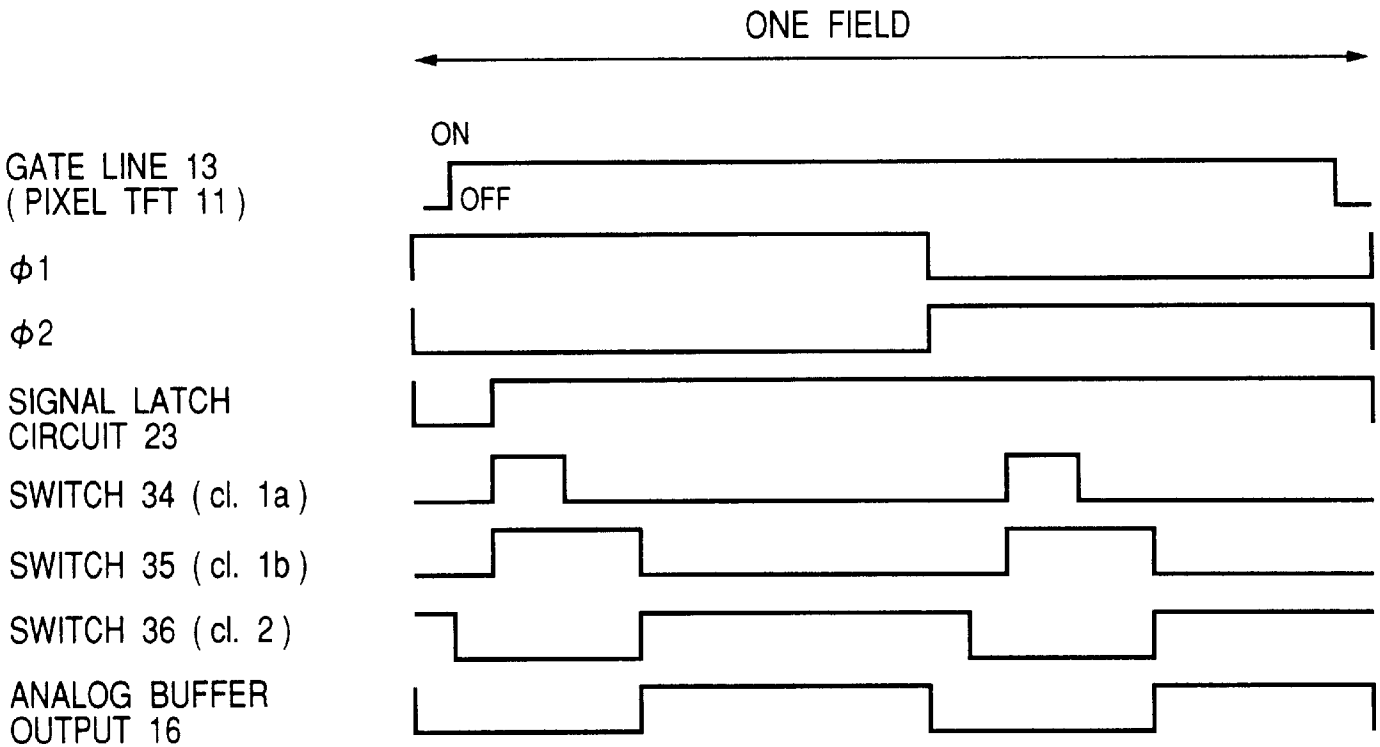
FIG. 6 is a timing chart of a second embodiment of the present invention.

FIG. 6 is a timing chart of the respective operation pulses according to the present embodiment in a certain row at the time of writing a pixel line during one field period. FIG. 6 corresponds to FIG. 5 for the first embodiment, however, in FIG. 6 the explanation with regard to the gradation change-over switches 14 and 15 which change-over positive/negative of the field is omitted. Because, other than the selection between A and B by the gradation change-over switches 14 and 15, the operation of the respective pulses in the positive and negative field is the same in the present embodiment. Further, likely in the present timing chart the on/off of the switches are indicated at high and low levels as illustrated in the drawing.

At the start of one field the phase ϕ1 is selected, subsequently a predetermined gate line 13 (a pixel TFT 11) which is selected by the gate line drive circuit 10 is turned on and the switch 36 is turned off. Following thereto, the offset cancel circuit in the analog buffer 20 (likely in the above, the operations in the analog buffers 20A and 20B are basically the same, both are inclusively referred to as an analog buffer 20 in the present embodiment) is started. Namely, the output of the primary latch circuit 23 is turned on as well as the switches 34 and 35 are turned on and the offset voltage of the differential amplifier 30 is inputted between the cancel capacitor 37. Subsequently, the switch 34 and the switch 35 are turned-off in this order. Subsequently, through the turning on of the switch 36 the offset voltage of the differential amplifier 30 stored in the cancel capacitor 37 is inputted into the negative feed back loop, thereby, the offset voltage due to TFT non matching of the differential amplifier 30 using poly crystalline Si-TFTs is canceled. Under this condition, when the analog buffer output switch 16 is turned on, a picture image signal voltage is outputted to a signal line 7 from the analog buffer 20. Under this condition, the fluctuation in feed through charge of the switch 34 connected to the input of the differential amplifier 30 is inputted to a pixel via a signal line 7 as a switch feed through offset voltage in an amount of (−q1A/Cm), which is substantially the same as in the first embodiment. However, in the present embodiment, at the time of writing the same pixel line the following operation is successively performed. Namely, after the analog buffer output switch 16 once turned off, the phase ϕ2 is selected and the output operation of the picture image signal voltage is again repeated. In this instance, the fluctuation in feed through charge of the switch 34 connected to the input of the differential amplifier circuit 30 is inputted to a pixel via a signal line 7 as a switch feed through offset voltage in an amount of (+q1/Cm). Thereafter, through turning off of the gate line 13 (pixel TFT 11) and the analog buffer output switch 16, the writing operation on the pixel for the selected one line is completed.

Figure 7:
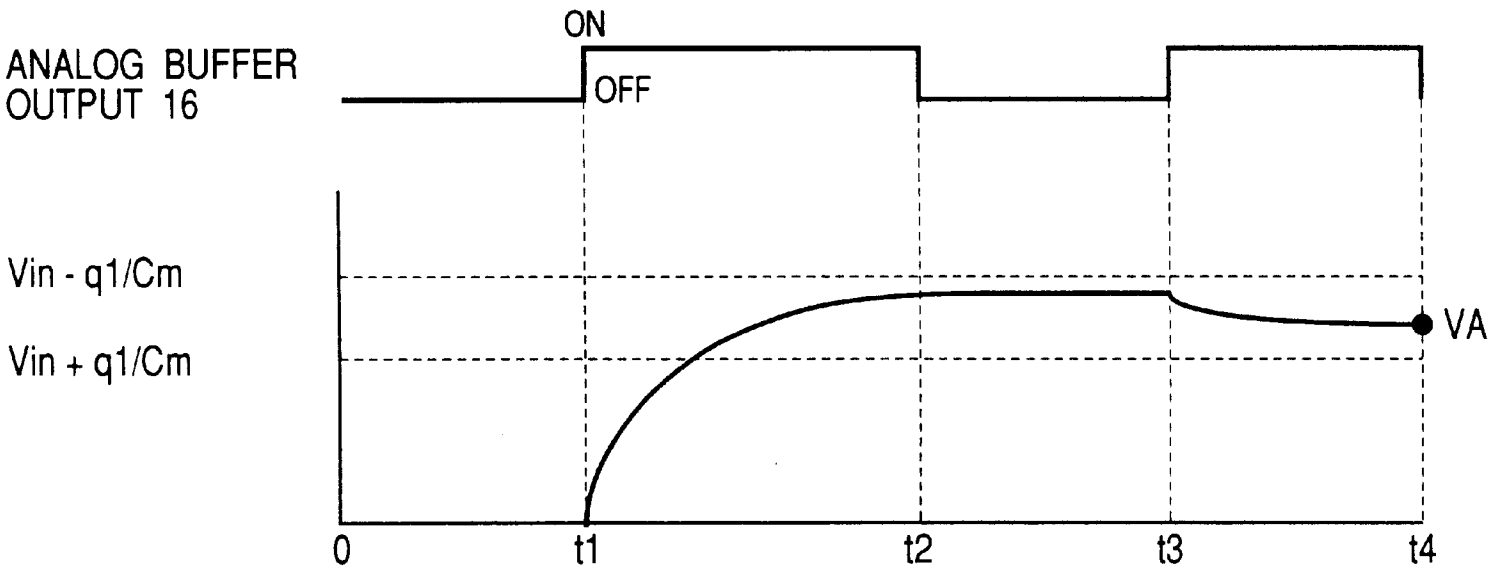
FIG. 7 is a diagram for explaining a picture image voltage which is written in to a signal line in the second embodiment of the present invention.

FIG. 7 shows a picture image signal voltage which is written to a signal line 7 through the above referred to writing operation. During a period from time t1 where the analog buffer output switch 16 is first time turned on to time t2, an output signal which gradually approaches to (Vin−q1/Cm) is written onto a signal line 7, wherein Vin is a picture image signal voltage to be written onto the signal line 7, and in the drawing q1 is indicated to have a negative value. Subsequently, during a period from time t3 where the analog buffer output switch 16 is second time turned on to time t4, an output signal which gradually approaches to (Vin+q1/Cm) is written on the signal line 7. In the present embodiment, the period (t4−t3) is set to a proper value shorter than the period (t2−t1), thereby, a picture image signal voltage VA which is finally written onto the signal line 7 comes close near the value Vin. Through the use of the above measure in the present embodiment, a reduction of the fluctuation in switch feed through offset voltage inputted to a pixel is realized.

Further, although in the present embodiment the phase change-over $\phi 1/\phi 2$ is performed once in one field, however, the phase change-over can be performed more than once in one field with the same effect.

Third Embodiment

Since the overall structure of the poly crystalline Si-TFT LC display panel of the third embodiment is the same as that of the first embodiment, the explanation thereof is omitted. Difference of the present embodiment from the first embodiment are in the circuit structure of the analog buffers 20A and 20B and the operation timing of the respective operation pulses. Hereinbelow, the points will be explained.

Figure 8:
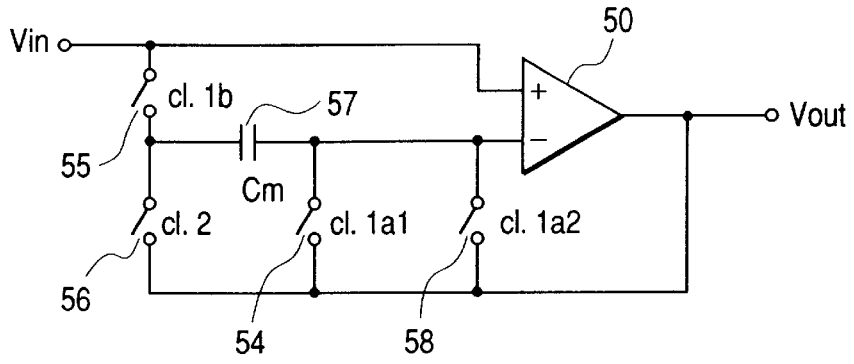
FIG. 8 is a structural diagram of a analog buffer circuit in a third embodiment of the present invention.

FIG. 8 is a circuit structure of an analog buffer 20 according to the present embodiment which includes the offset cancel function and the switch feed through offset cancel function, and likely in the present embodiment, the operations of the analog buffers 20A and 20B are basically the same, the both are referred to as the analog buffer 20.

An input terminal of the analog buffer 20 is connected to a switch 55 which is turned on by a clock cl.1*b* and a positive input terminal of the differential amplifier 50, further a negative input terminal of the differential amplifier 50 is connected to a switch 54 which is turned on by a clock cl.1*a*1, a switch 58 which is turned on by a clock cl.1*a*2 and a cancel capacitor 57, and the other terminal of the cancel capacitor 57 is connected to the switch 55 which is turned on by a clock cl.1*b* and a switch 56 which is turned on by a clock cl.2. Further, the output terminal of the differential amplifier 50 is connected to the terminal of the analog buffer 20 as well as at the same time is connected to respective other terminals of the switch 54 which is turned on by a clock cl.1*a*1, of the switch 58 which is turned on by a clock cl.1*a*2 and of the switch 56 which is turned on by a clock cl.2.

Now, the operation of the above analog buffer 20 will be explained with reference to FIG. 9.

Figure 9:
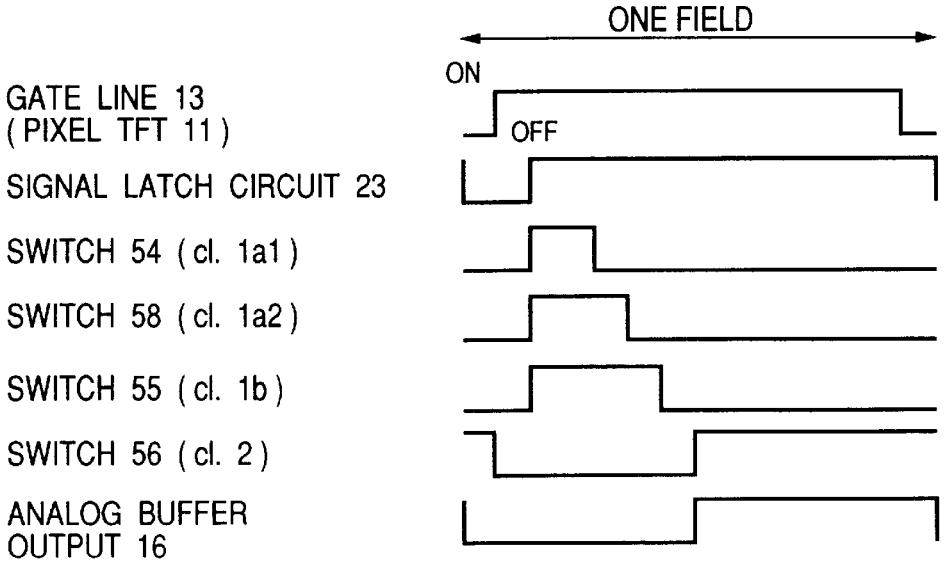
FIG. 9 is a timing chart in the third embodiment of the present invention.

FIG. 9 is a timing chart of the respective operation pulses according to the present embodiment in a certain row at the time of writing a pixel line during one field period and corresponds to FIG. 6 for the second embodiment.

At the start of one field a predetermined gate line 13 (a pixel TFT 11) which is selected by the gate line drive circuit 10 is turned on and the switch 56 is turned off. Following thereto, the offset cancel circuit in the analog buffer 20 is started. Namely, the output of the primary latch circuit 23 is turned on as well as the switches 54, 55 and 58 are turned on and the offset voltage of the differential amplifier 50 is inputted between the cancel capacitor 57. Subsequently, the switch 54, the switch 58 and the switch 55 are turned off in this order. Subsequently, through the turning on of the switch 56 the offset voltage of the differential amplifier 50 stored in the cancel capacitor 57 is inputted into the negative feed back loop, thereby, the offset voltage due to TFT non matching of the differential amplifier 50 using poly crystalline Si-TFTs is canceled. Under this condition, when the analog buffer output switch 16 is turned on, a picture image signal voltage is outputted to a signal line 7 from the analog buffer 20. In the present embodiment, the gate width of the switch 58 which is turned off later is designed to be smaller that the gate width of the switch 54 which is turned off earlier. However, the gate lengths of the both are the same. Namely, the charging to the cancel capacitor 57 is performed by the switch 54 having a large switch feed through charge and a lower on resistance, further, the reduction of the switch feed through charge is achieved by the switch 58 having a larger on resistance but a smaller switch feed through charge. According to the present embodiment, with a smaller circuit scale than those of first and second embodiments the fluctuation in switch feed through offset voltage can be reduced.

Further, in the present embodiment, the gate width of the switch 58 which is turned off later is designed smaller than the gate width of the switch 54 which is turned off earlier. However, the principle of the present invention can be modified in various manners, for example, in such a manner that the gate of the switch 58 which is turned off later is driven by a lower gate voltage than that for the gate of the switch 54 which is turned off earlier.

Fourth Embodiment

Figure 10:
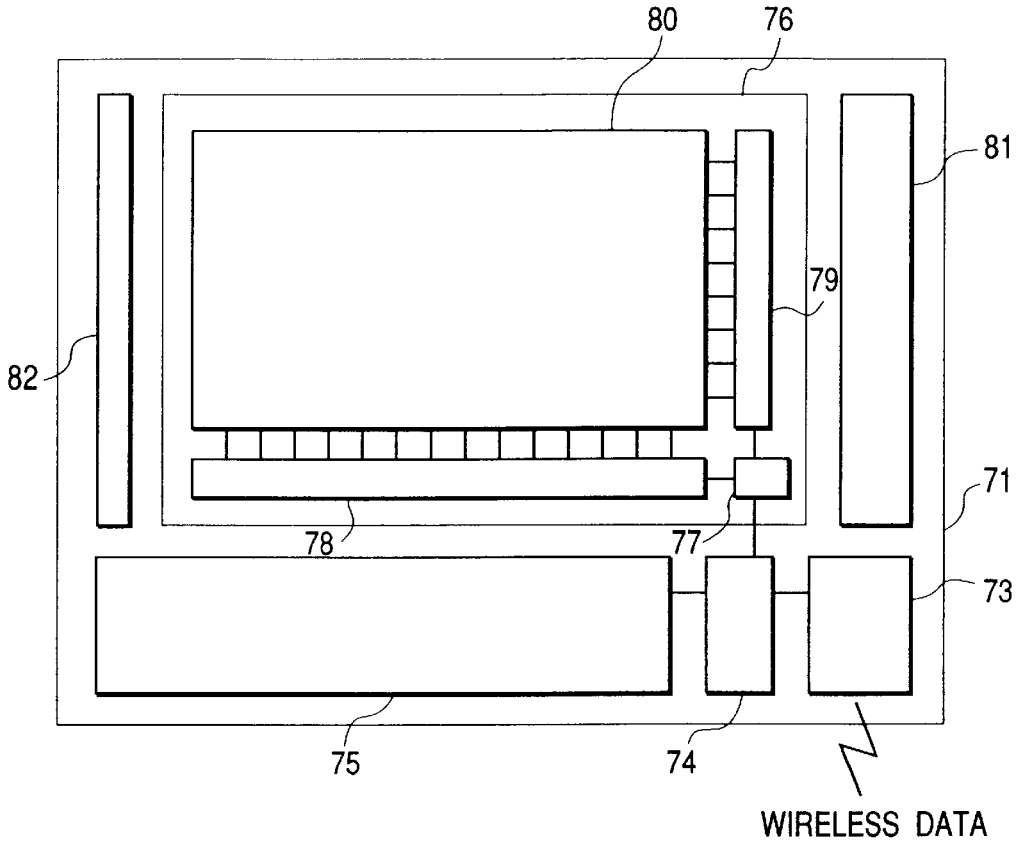
FIG. 10 is a structural diagram of a picture image viewer in a fourth embodiment of the present invention.
Figure 11:
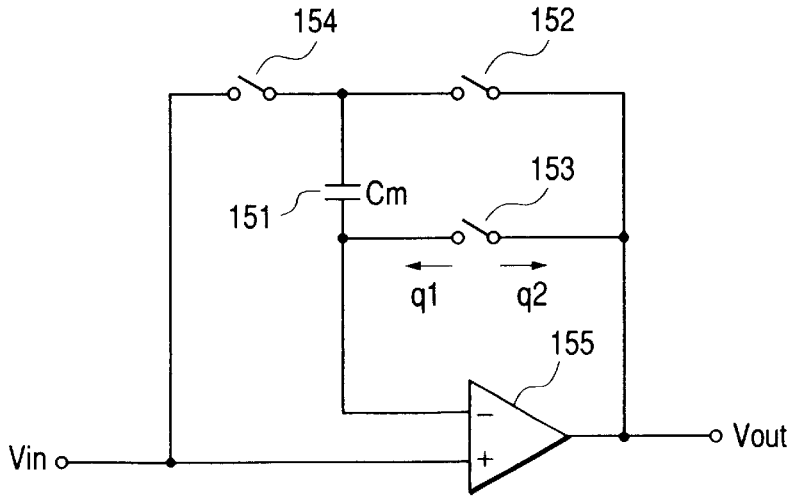
FIG. 11 is a structural diagram of a conventional offset cancel buffer circuit used for driving a TFT LC panel.

FIG. 10 is a structural diagram of a picture image viewer 71 representing a fourth embodiment of the present invention.

To a wireless interface (I/F) circuit 73 compressed picture image data are inputted from the outside as wireless data based on bluetooth standard, and the output of the wireless I/F circuit 73 is connected via a central processing unit (CPU)/decoder 74 to a frame memory 75. Further, the output of the CPU/decoder 74 is connected via an interface (I/F) circuit 77 provided on a poly crystalline Si LC display panel 76 to a line selection circuit 79 and a data input circuit 78, and a picture image display region 80 is driven by the line selection circuit 79 and the data input circuit 78. A picture image viewer 71 is further provided with a power source 82 and a light source 81. The structure and operation of the poly crystalline Si LC display panel 76 in the present embodiment are the same as those of the first embodiment.

Hereinbelow, an operation of the fourth embodiment will be explained. The wireless I/F circuit 73 takes in compressed picture image data from the outside and transfers the same to the CPU/decoder 74. The CPU/decoder 74, in response to a user's manipulation, drives the picture image viewer depending on necessity or performs decoding process of the compressed picture image data. The decoded picture image data are temporarily stored in the frame memory 75 and, according to the command from the CPU/decoder 75, outputs the stored picture image data for displaying picture images and timing pulses to the I/F circuit 77. The I/F circuit 77 drives the line selection circuit 79 and the data input circuit 78 to display picture images on the picture image display region while making use of these signals, which is already explained in connection with the first embodiment, therefore, the detailed explanation thereof is omitted. The light source is a back light for the LC display, the power source 82 includes a secondary battery and supplies power for driving these entire device.

The fourth embodiment can display picture images with a high quality without uneven brightness in a form of vertical stripes due to "switch feed through offset fluctuation" as referred to above based on the compressed picture image data.

According to the present invention, a LC picture image display device which permits a high quality picture image display can be provided.

What is claimed is:

1. A picture image display device comprising:

a display unit constituted by a plurality of pixels, each pixel including an opposing electrode to which a predetermined voltage is applied;

a pixel electrode provided to form a capacitor with the opposing electrode;

a pixel switch connected in series with the pixel electrode;

picture image signal voltage generation means which outputs a first analog picture image signal voltage based on picture image data to be displayed;

output impedance conversion means using a semiconductor element to which the first analog picture image signal voltage is inputted and which outputs a second analog picture image signal voltage with a lower output impedance than that of the first analog picture image signal voltage;

an offset cancel circuit including an offset cancel capacitor provided in the output impedance conversion means to cancel an output offset fluctuation of the second analog picture image signal voltages due to fluctuation of the semiconductor characteristic in the output impedance conversion means and of which one terminal is connected to a voltage input terminal of the output impedance conversion means;

a first semiconductor switch of which one terminal is connected to the voltage input terminal of the output impedance conversion means;

a signal line which connects output terminals of the output impedance conversion means with the pixel switches;

signal voltage writing means which writes the second analog picture image signal voltage representing the outputs of the output impedance conversion means, via the signal lines, and the pixel switches into a capacitor in a predetermined display pixel; and means for reducing an output fluctuation in the second analog picture image signal voltage due to fluctuation in feed through charges caused when the first semiconductor switch is turned off, wherein the output impedance conversion means includes a differential amplifier circuit and a voltage follower circuit which effects a negative feed back to the differential amplifier circuit; and wherein the offset cancel circuit includes the offset cancel capacitor of which one terminal is connected to a first input terminal of the differential amplifier circuit, a second semiconductor switch which connects the other terminal of the offset cancel capacitor with a second input terminal of the differential amplifier circuit, a third semiconductor switch which connects a first node with the other terminal of the offset cancel capacitor, the first semiconductor switch which connects the first node with the first input terminal of the differential amplifier circuit, a fourth semiconductor switch which connects the second input terminal of the differential amplifier circuit with the output of the differential amplifier circuit, a fifth semiconductor switch which connects the first node with the output of the differential amplifier circuit, a sixth semiconductor switch which connects the output to the offset cancel circuit selectively either to the second input terminal of the differential amplifier circuit or to the first node, and differential amplifier circuit positive and negative inversion means which permits selective setting either the first and second input terminals of the differential amplifier circuit at negative input and positive input or at positive input and negative input.

2. A picture image display device according to claim 1, wherein the differential amplifier circuit includes a current source, a pair of differential driver FETs (Field Effect Transistors) and a pair of load FETs of which gates are connected commonly to a drain of one of the pair of differential driver FETs, and the differential amplifier circuit positive and negative inversion means includes a pair of seventh semiconductors which connect the gates of the pair of load FETs selectively either of the pair of differential driver FETs and a pair of eighth semiconductor switches which take the output of the differential amplifier circuit from one of the pair of differential driver FETs non-selected by the pair of seventh semiconductor switches.

3. A picture image display device according to claim 1, wherein, between the output impedance conversion means and the signal line, a ninth semiconductor switch is provided for connecting and disconnecting the signal line to the output impedance conversion means.

4. A picture image display device according to claim wherein the first semiconductor switch is a poly crystalline Si-TFT (Thin Film Transistor).

5. A picture image display device according to claim 1, wherein the first semiconductor switch is a CMOS (Complementary Metal Oxide Semiconductor) switch.

6. A driving method of a picture image display device which comprises: a display unit constituted by a plurality of pixels, each pixel includes an opposing electrode to which a predetermined voltage is applied; a pixel electrode provided to form a capacitor with the opposing electrode; a pixel switch connected in series with the pixel electrode; picture image signal voltage generation means which outputs a first analog picture image signal voltage based on picture image data to be displayed; output impedance conversion means in group including a voltage follower circuit in which a negative feed back is effected to a differential amplifier circuit to which the first analog picture image signal voltage is inputted and which outputs a second analog picture image signal voltage with a lower output impedance than that of the first analog picture image signal voltage; an offset cancel circuit in group including an offset cancel capacitor provided in the output impedance conversion means in group for canceling an output offset fluctuation of the second analog picture image signal voltages due to fluctuation of the semiconductor characteristics of semiconductor elements constituting the differential amplifier circuit in the respective output impedance conversion means in group and of which one terminal is connected to a first input terminal of the differential amplifier circuit, a second semiconductor switch which connects the other terminal of the offset cancel capacitor with a second input terminal of the differential amplifier circuit, a third semiconductor switch which connects a first node with the other terminal of the offset cancel capacitor, a first semiconductor switch which connects the first node with the first input terminal of the differential amplifier circuit, a fourth semiconductor switch which connects the second input terminal of the differential amplifier circuit with the output of the differential amplifier circuit, a fifth semiconductor switch which connects the first node with the output of the differential amplifier circuit, a sixth semiconductor switch which connects the output to the offset cancel circuit selectively either to the second input terminal of the differential amplifier circuit or to the first node, and differential amplifier circuit positive and negative inversion means which permits selective setting either the first and second input terminals of the differential amplifier circuit at negative input and positive input or at positive input and negative input; a signal line in group which connects output terminals of the output impedance conversion means in group with the pixel switches in group; and signal voltage writing means which writes the second analog picture image signal voltage representing the outputs of the output impedance conversion means in group via the signal lines in group and the pixel switches in group into a capacitor in a predetermined display pixel, wherein:

a first offset cancel operation in which under a condition where the fourth semiconductor switch is turned off, the fifth semiconductor switch is turned on and the sixth semiconductor switch is connected to the second input terminal of the differential amplifier circuit, the first, second and third semiconductor switches are opened and closed in a predetermined order to perform offset cancel, and a second offset cancel operation in which under a condition where the fourth semiconductor switch is turned on, the fifth semiconductor switch is turned off and the sixth semiconductor switch is connected to the first node, the first, second and third semiconductor switches are opened and closed in a predetermined order to perform offset cancel, are selectively performed.

7. A driving method according to claim 6, wherein, during the offset cancel operations, the second semiconductor switch is turned off after the first semiconductor switch is turned off.

8. A driving method according to claim 6, wherein the first offset cancel operation and the second offset cancel operation are respectively performed alternatively for every frame.

9. A driving method according to claim 6, wherein the first offset cancel operation and the second offset cancel operation are performed once respectively during a single display frame.

10. A driving method according to claim 9, wherein a period for former offset cancel operation during the display field is longer than a period for later offset cancel operation during the single display field.

11. A driving method according to claim 6, wherein the first offset cancel operation is performed n times during a single display field.

12. A picture image display device according to claim 1, wherein the offset cancel circuit includes the offset cancel capacitor of which one terminal is connected to a negative input terminal of the differential amplifier circuit, a second semiconductor switch which connects the other terminal of the offset cancel capacitor with a positive input terminal of the differential amplifier circuit, a third semiconductor switch which connects the other terminal of the offset cancel capacitor with the output terminal of the differential amplifier circuit, and the first semiconductor switch which connects the negative input terminal of the differential amplifier circuit with the output terminal of the differential amplifier circuit, in which the input of the offset cancel circuit is connected to the positive input terminal of the differential amplifier circuit and the first semiconductor switch is constituted by a plurality of semiconductor switches connected in parallel.

13. A picture image display device according to claim 12, wherein each of the plurality of semiconductor switches forming the first semiconductor switch is respectively constituted by a FET (Field Effect Transistor), and ratios of (gate width )/(gate length) of the plurality of semiconductor switches are respectively differentiated.

14. A driving method of a picture image display device which comprises: a display unit constituted by a plurality of pixels, each pixel includes an opposing electrode to which a predetermined voltage is applied; a pixel electrode provided to form a capacitor with the opposing electrode; a pixel switch connected in series with the pixel electrode; picture image signal voltage generation means which outputs a first analog picture image signal voltage based on picture image data to be displayed on the display unit; output impedance conversion means in group including a voltage follower circuit in which a negative feed back is effected to a differential amplifier circuit to which the first analog picture image signal voltage is inputted and which outputs a second analog picture image signal voltage with a lower output impedance than that of the first analog picture image signal voltage; an offset cancel circuit in group including an offset cancel capacitor provided in the output impedance conversion means in group for canceling an output offset fluctuation of the second analog picture image signal voltages due to fluctuation of the semiconductor characteristics of semiconductor elements constituting the differential amplifier circuit in the respective output impedance conversion means in group and of which one terminal is connected to a negative input terminal of the differential amplifier circuit, a second semiconductor switch which connects the other terminal of the offset cancel capacitor with a positive input terminal of the differential amplifier circuit, a third semiconductor switch which connects the other terminal of the offset cancel capacitor with the output terminal of the differential amplifier circuit and a first semiconductor switch which connects the negative input terminal of the differential amplifier circuit with the output terminal of the differential amplifier circuit, and the input of the offset cancel circuit is connected to the positive input terminal of the differential amplifier circuit and the first semiconductor switch is constituted by a plurality of semiconductor switches connected in parallel; a signal line in group which connects output terminals of the output impedance conversion means in group with the pixel switches in group; and signal voltage writing means which writes the second analog picture image signal voltage representing the outputs of the output impedance conversion means in group via the signal lines in group and the pixel switches in group into a capacitor in a predetermined display pixel, wherein:

when performing the offset cancel operation, while opening and closing the first, second and third semiconductor switches in a predetermined order, a plurality of semiconductor switches forming the first semiconductor switch are sequentially and successively turned off.

15. A driving method according to claim 14, wherein during the offset cancel operation after all of the first semiconductor switch is turned off, the second semiconductor switch is successively turned off.

16. A picture image display device according to claim 1, wherein the display pixels in group, the picture image signal voltage generation means, the output impedance conversion means in group, the signal voltage writing means are constituted on a common insulative substrate by making use of poly crystalline Si-TFTs (Thin Film Transistors).

17. A picture image display device according to claim 1, wherein compressed picture image data is prolonged, and picture image display is performed based on the prolonged picture image data on a display region of the display unit.

18. A liquid crystal display device comprising:

a display unit which includes a pair of substrates at least one of which is transparent, a liquid crystal layer disposed between the pair of substrates, a plurality of scanning lines and a plurality of signal lines arranged so as to cross the plurality of scanning lines both of which are disposed on at least one of the pair of the substrates;

a scanning signal drive circuit connected to the scanning lines; and a picture image signal drive circuit connected to the signal lines, which produces a first analog picture image signal voltage based on picture image data to be displayed on the display unit; wherein the picture image signal drive circuit includes:

output impedance conversion means which, when the first analog picture image signal voltage is transmitted to the display unit, converts the first analog picture image signal voltage to a second analog picture image signal voltage having a lower impedance than that of the first analog picture image signal voltage, a differential amplifier circuit which is constituted by a plurality of semiconductor elements serving as switching elements, of which positive and negative polarities of two input terminals are changed over at first and second timings and third and fourth timings, and of which output terminal is connected to the output terminal of the output impedance conversion means, and wherein:

at the first timing, a circuit is formed in which one terminal from an input terminal is connected to a positive input terminal of the differential amplifier circuit, one terminal branched from the input terminal is connected via an offset cancel capacitor to a negative input terminal of the differential amplifier circuit and further one terminal branched from the midway between the offset cancel capacitor and the differential amplifier circuit is connected to an output terminal, at the second timing, a circuit is formed in which the input terminal is connected to the positive input terminal of the differential amplifier circuit and the output terminal is connected via the offset cancel capacitor to the negative input terminal of the differential amplifier circuit, at the third timing, a circuit is formed in which one terminal of the input terminal is connected to the positive input terminal of the differential amplifier circuit and further one terminal branched from the input terminal is connected via the offset cancel capacitor to the negative input terminal of the differential amplifier circuit and the output terminal, and at the fourth timing, a circuit is formed in which the input terminal is connected via the offset cancel capacitor to the positive input terminal of the differential amplifier circuit and further the output terminal is connected to the negative input terminal of the differential amplifier circuit.

19. A liquid crystal display device according to claim 18, wherein, in the differential amplifier circuit, the positive input terminal at the first and second timings is rendered to the negative input terminal at the third and fourth timings.

20. A picture image display device according to claims 1, wherein the output impedance conversion means includes a differential amplifier circuit and a voltage follower circuit to effect a negative feed back to the differential amplifier circuit.

21. A picture image display device according to claim 1, wherein the differential amplifier circuit is constituted by a cascode connection.

22. A picture image display device according to claim 20, wherein a source follower circuit is provided at the output of the differential amplifier circuit.

23. A picture image display device according to claim 1, wherein the picture image signal voltage generation means is constituted by a plurality of reference gradation voltage lines to which respective reference gradation voltages are applied, and a reference gradation voltage line selection circuit which selects a predetermined reference gradation voltage line based on digital picture image data from the plurality of reference gradation voltage lines and outputs the same.

24. A picture image display device according to claim 1, wherein the reference gradation voltage line selection circuit is arranged to select alternatively one set among two sets of reference gradation voltage lines for every field.

* * * * *